US011071354B2

(12) United States Patent
Song

(10) Patent No.: US 11,071,354 B2
(45) Date of Patent: Jul. 27, 2021

(54) UNIVERSAL SHOE FASTENER SYSTEM

(71) Applicant: Gyuwon Song, Pacific Grove, CA (US)

(72) Inventor: Gyuwon Song, Pacific Grove, CA (US)

( * ) Notice: Subject to any disclaimer, the term of this patent is extended or adjusted under 35 U.S.C. 154(b) by 0 days.

(21) Appl. No.: 16/918,951

(22) Filed: Jul. 1, 2020

(65) Prior Publication Data

US 2021/0022450 A1 Jan. 28, 2021

Related U.S. Application Data

(62) Division of application No. 15/405,120, filed on Jan. 12, 2017, now abandoned.

(60) Provisional application No. 62/279,304, filed on Jan. 15, 2016.

(51) Int. Cl.
*A43C 11/00* (2006.01)
*A43C 11/14* (2006.01)

(52) U.S. Cl.
CPC ..... *A43C 11/1493* (2013.01); *A43C 11/004* (2013.01); *A43C 11/008* (2013.01)

(58) Field of Classification Search
CPC ..... A43C 11/1493; F16B 2/10
See application file for complete search history.

(56) References Cited

U.S. PATENT DOCUMENTS 449,273 A * 3/1891 Raymond ..... A43C 3/00 24/714.4
808,028 A * 12/1905 Ellis ..... A43C 11/18 12/113
876,341 A * 1/1908 Forstner ..... A41F 1/04 24/683
887,942 A * 5/1908 Houghland ..... A43C 3/04 24/14.1
991,443 A * 5/1911 Heath ..... A43C 3/04 24/714.1
1,548,407 A * 8/1925 Chisholm ..... A43C 5/00 24/714.9
1,995,243 A * 3/1935 Clarke ..... A43C 1/00 24/713.3
3,137,952 A * 6/1964 Shears ..... A43C 11/14 36/50.1
3,205,544 A * 9/1965 Streule ..... A43C 11/1493 24/306
729,300 A * 8/1981 Antonious ..... A43B 5/00 24/306
4,907,352 A * 3/1990 Ginsberg ..... A43C 11/1493 12/113
5,109,581 A * 5/1992 Gould ..... A43C 5/00 24/712.1

(Continued)

*Primary Examiner* — Jason W San
(74) *Attorney, Agent, or Firm* — UCLA Patent Law Clinic

(57) ABSTRACT

Universal shoe fastening systems in accordance with embodiments of the invention are provided. In one embodiment, a shoe fastening system for a shoe includes an anchoring strap-clip configured to attach to a first pair of eyelets of the shoe, an adjustment strap-clip configured to attach to a second pair of eyelets of the shoe, and a strap closure that includes an anchoring end portion configured to attach the anchoring strap-clip, an adjustable end portion configured to traverse under a bar region of the adjustment strap-clip that allows for the shoe to be fasten, and a fastening portion configured to connect the anchoring end portion with the adjustable end portion.

20 Claims, 19 Drawing Sheets

(56) References Cited

U.S. PATENT DOCUMENTS

| | | | | | |
|---|---|---|---|---|---|
| 5,230,171 | A * | 7/1993 | Cardaropoli | A43C 11/14 | 36/50.1 |
| 5,526,585 | A * | 6/1996 | Brown | A43B 11/00 | 36/50.1 |
| 5,557,864 | A * | 9/1996 | Marks | A43C 11/00 | 24/306 |
| 5,572,774 | A * | 11/1996 | Duren | A43B 11/00 | 24/302 |
| 5,894,640 | A * | 4/1999 | Dewey | A43C 11/00 | 24/306 |
| 6,173,509 | B1 * | 1/2001 | Bowen | A43C 11/00 | 24/712 |
| 6,219,891 | B1 * | 4/2001 | Maurer | A43C 1/00 | 24/713.2 |
| 6,936,019 | B2 * | 8/2005 | Mason | A61F 5/01 | 602/12 |
| 7,437,837 | B2 * | 10/2008 | Jacobs | A43B 3/24 | 36/50.1 |
| 7,500,323 | B2 * | 3/2009 | Rasmussen | A43B 1/0081 | 36/50.1 |
| 8,060,995 | B2 * | 11/2011 | Issler | A43C 3/00 | 24/714.6 |
| 9,185,948 | B2 * | 11/2015 | Ben-Arie | A43C 7/04 | |
| 9,743,715 | B1 * | 8/2017 | Brekke-Jones | A43B 3/242 | |
| 10,010,138 | B1 * | 7/2018 | Nicholson | A43C 1/04 | |
| 2005/0044747 | A1 * | 3/2005 | Doody | A43B 3/24 | 36/50.1 |
| 2017/0119088 | A1 * | 5/2017 | Regan | A43B 3/0031 | |

* cited by examiner

UNIVERSAL SHOE FASTENER SYSTEM

CROSS REFERENCE TO RELATED APPLICATIONS

This current application is a divisional application of U.S. patent application Ser. No. 15/405,120, filed on Jan. 12, 2017, which claims priority to U.S. Provisional Patent Application No. 62/279,304, filed Jan. 15, 2016, the disclosures of which are incorporated herein in their entirety by reference.

BACKGROUND OF THE INVENTION

Field of the Invention

The present invention is in the technical field of footwear, and pertains more particularly to a system for replacing show laces with strap fasteners and clip elements.

Background

Shoes with eyelets utilizing shoe laces are well-known in the art. Shoe laces are known to be somewhat difficult to engage in eyelets of shoes to lace and tie the shoes, and tying the shoes with laces is known to be a tedious experience. What is clearly needed is a system to replace shoe laces with strap fasteners while using the existing eyelets in a variety of shoes.

SUMMARY OF THE INVENTION

Systems and methods for universal shoe fastening in accordance with embodiments of the invention are disclosed. In one embodiment, a shoe fastening system for a shoe includes an anchoring strap-clip configured to attach to a first pair of eyelets of the shoe that includes two parallel regions configured to be positioned inside the shoe under the first pair of eyelets, a bar region configured to traverse the first pair of eyelets on the outside of the shoe, and two curved regions connecting the parallel regions to the bar region, where the two curved regions traverse through the first pair of eyelets; an adjustment strap-clip configured to attach to a second pair of eyelets of the shoe that includes two parallel regions configured to be positioned inside the shoe under the second pair of eyelets, a bar region configured to traverse the second pair of eyelets on the outside of the shoe, and two curved regions connecting the parallel regions to the bar region, where the two curved regions traverse through the second pair of eyelets; and a strap closure that includes an anchoring end portion configured to attach to the bar region of the anchoring strap-clip, an adjustable end portion configured to traverse under the bar region of the adjustment strap-clip that allows for the shoe to be fasten, and a fastening portion configured to connect the anchoring end portion with the adjustable end portion.

In a further embodiment, the adjustment strap-clip further includes a second bar region configured to traverse the second pair of eyelets on the outside of the shoe that is parallel to the bar region.

In another embodiment, the bar region is separable into a first and second split bar region.

In a still further embodiment, the first split bar region includes a female threaded end and the second split bar region includes an extended male thread that engages the female threaded end.

In still another embodiment, the bar region further includes an engagement portion including a left-hand female thread on one end and a right-hand female thread on the other end.

In a yet further embodiment, the engagement portion has a circular profile and longitudinal raised striations on the outside surface around the circumference of the engagement portion.

In yet another embodiment, the engagement portion has a hexagonal profile having six flat surfaces around the circumference of the engagement portion.

In a further embodiment again, the first split bar region includes a right-hand male thread that mates with the engagement portion's right-hand female thread and the second split bar region includes a left-hand male thread that mates with the engagement portion's left-hand female thread.

In another embodiment again, the anchoring strap-clip further includes a hook element for securing the anchoring strap-clip in the first pair of eyelets.

In a further additional embodiment, the adjustment strap-clip further includes a hook element for securing the adjustment strap-clip in the second pair of eyelets.

A further embodiment includes a shoe fastening system for a shoe includes an anchoring strap-clip configured to attach to a first pair of eyelets of the shoe that includes a bar region configured to traverse the first pair of eyelets on the outside of the shoe, two curved regions connecting the parallel regions to the bar region, where the two curved regions traverse through the first pair of eyelets, and two threaded regions extending from the two parallel regions, where the two threaded regions are configured to receive two threaded knobs to keep the anchoring strap-clip attached to the first pair of eyelets; an adjustment strap-clip configured to attach to a second pair of eyelets of the shoe that includes a bar region configured to traverse the second pair of eyelets on the outside of the shoe, two curved regions connecting the parallel regions to the bar region, where the two curved regions traverse through the second pair of eyelets, and two threaded regions extending from the two parallel regions, where the two threaded regions are configured to receive two threaded knobs to keep the adjustment strap-clip attached to the second pair of eyelets; a strap closure that includes an anchoring end portion configured to attach to the bar region of the anchoring strap-clip, an adjustable end portion configured to traverse under the bar region of the adjustment strap-clip that allows for the shoe to be fasten, and a fastening portion configured to connect the anchoring end portion with the adjustable end portion.

In a still yet further embodiment, the adjustment strap-clip further includes a second bar region configured to traverse the second pair of eyelets on the outside of the shoe that is parallel to the bar region.

In still yet another embodiment, the bar region is separable into a first and second split bar region.

In a still further embodiment again, the first split bar region includes a female threaded end and the second split bar region includes an extended male thread that engages the female threaded end.

In still another embodiment again, the bar region further includes an engagement portion with a right-hand female thread and a left-hand female thread.

In a still further additional embodiment, the engagement portion has a circular profile.

In still another additional embodiment, the engagement portion has a hexagonal profile.

In a yet further embodiment again, the first split bar region includes a right-hand male thread that mates with the engagement portion's right-hand female thread and the second split bar region includes a left-hand male thread that mates with the engagement portion's left-hand female thread.

In yet another embodiment again, the anchoring strap-clip further includes a hook element for securing the anchoring strap-clip in the first pair of eyelets.

In a yet further additional embodiment, the adjustment strap-clip further includes a hook element for securing the adjustment strap-clip in the second pair of eyelets.

DETAILED DESCRIPTION OF THE INVENTION

Figure 1A:
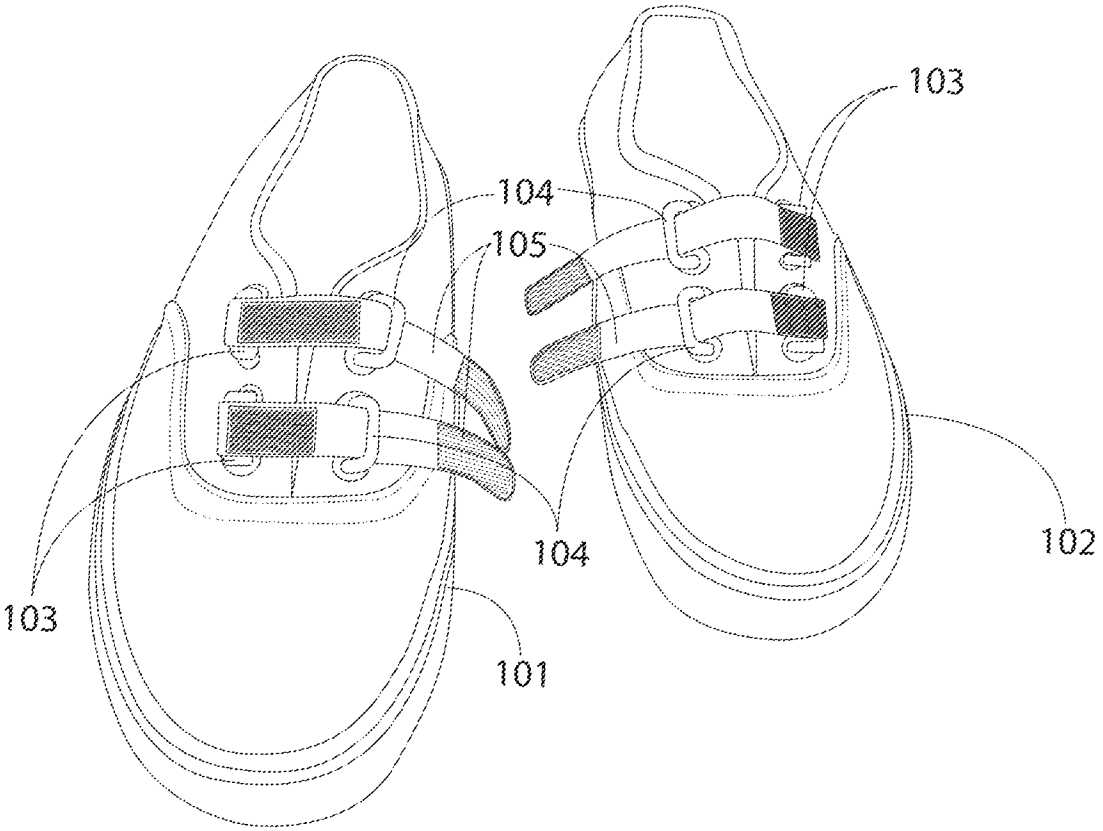
FIG. 1*a* is a perspective view of a pair of cloth shoes using strap-clips in the eyelets, with strap-closures, according to an embodiment of the present invention.

FIG. 1*a* is a perspective view of a pair of cloth shoes, left 102 and right 101, using strap-clips 103 and 104 in the eyelets, with strap-closures 105, according to an embodiment of the present invention. The fact that cloth shoes are shown is not limiting, as the invention in different embodiments is useful for any shoes that have eyelets for shoe laces. In various embodiments, the strap-clips 103 and 104 may be different where one strap-clip may be used for anchoring purposes (may also be referred to as "anchoring strap-clip") and the other strap-clip may be used for adjusting purposes (may also be referred to as "adjusting strap-clip"). In some embodiments, the two strap-clips may be similar or identical in structure. In further embodiments, the two strap-clips may be different in structure as further described below.

The shoes shown in this example have four lace-eyelets on each side of each shoe over a tongue. The eyelets are typically used for conventional laces, which have to be threaded through the eyelets from the bottom up. In use one must tie and untie the laces to put the shoes on or take them off.

Figure 1B:
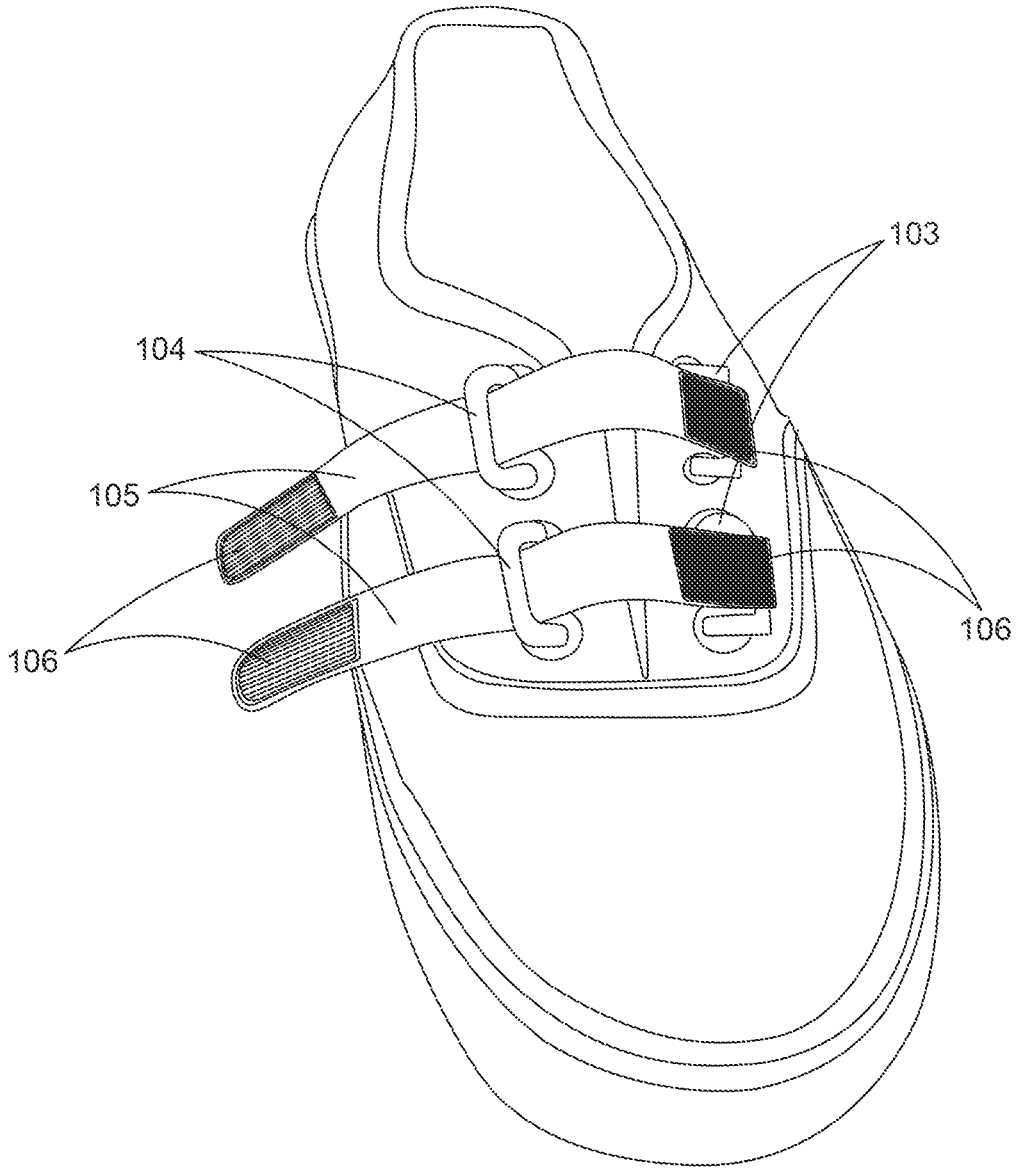
FIG. 1*b* is a magnified view of a portion of FIG. 1*a* showing further details of elements in an embodiment of the invention.

FIG. 1*b* is a somewhat magnified view of a portion of FIG. 1*a*, showing just the elements of the left shoe 102. In this magnified view it may be seen that the strap-closures 105 are anchored at one end to strap-clips 103, and pass under a bar of strap-clips 104. The strap-closures may then be pulled tight and pressed back over the anchored portion, to which they connect by hook-and-eye cloth, such as Velcro™ pads 106. Each strap-clip engages two eyelets on one side, so two strap-clips on each side and two strap-closures are sufficient. In this implementation two quick pulls undo the closure, and two simple pulls and folds reclose the straps. This is seen to be much simpler than shoelaces.

Figure 2A:
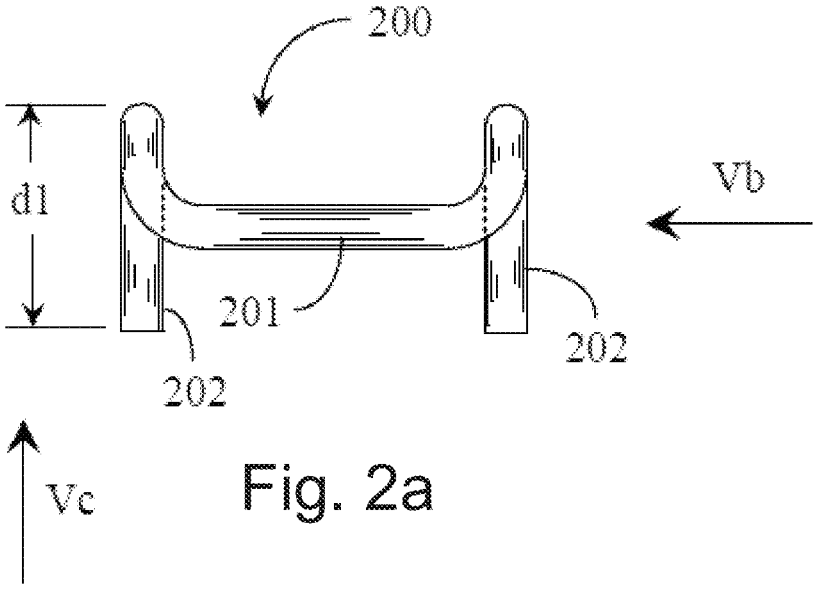
FIG. 2*a* is a top-down view of a simplified strap-clip in an embodiment of the invention.
Figure 2B:
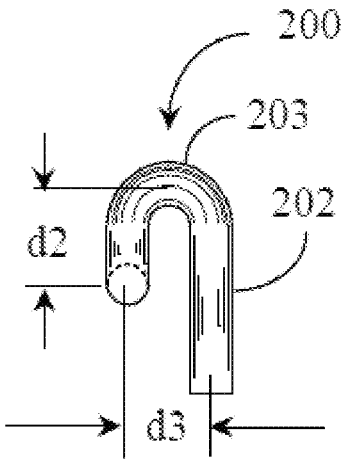
FIG. 2*b* is a side view of the strap-clip of FIG. 2*a*, in the direction of arrow Vb.
Figure 2C:
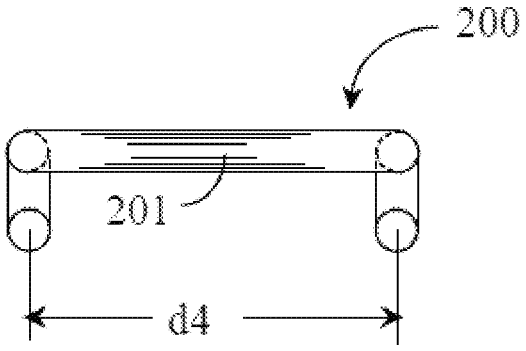
FIG. 2*c* is an end view of the strap-clip of FIG. 2*a* in the direction of arrow Vc.

FIG. 2*a* is a top-down view of a simplified strap-clip 200 in an embodiment of the invention. FIG. 2*b* is a side view of the strap-clip of FIG. 2*a*, in the direction of arrow Vb. FIG. 2*c* is an end view of the strap-clip of FIG. 2*a* in the direction of arrow Vc. Strap-clip 200 in FIG. 2*a* comprises a bar region 201 that in this example is formed of a round rod material, which may be metal or polymer in different embodiments. At each end of bar region 201 the rod material turns through a radius to extend at a right angle to a central axis of the bar region, both extensions in the same direction. At the end of these extensions, the rod turns through a radius and through 180 degrees, indicated as regions 203 in FIG. 2*b*, and then extends on each side in parallel regions 202.

Figure 3A:
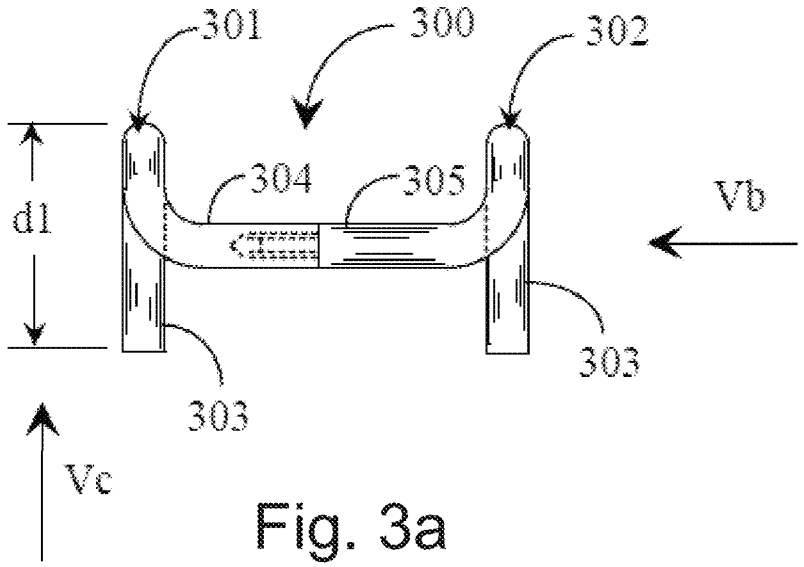
FIG. 3*a* is a top-down view of a strap-clip in an alternative embodiment of the invention.

FIG. 3*a* is a top-down view of a strap-clip in an alternative embodiment of the invention. In this embodiment there are two separate portions 301 and 302 that engage to provide strap-clip 300. Portion 301 comprises an extension 303 which is analogous to extension 202 in FIG. 2*a*, and has a bar region 304 that has a female threaded end. Portion 302 is a mirror image in shape of portion 301, has an extension 303, and a bar region 305 that has an extended male thread that engages the female thread of bar region 304 to provided a strap-clip of the same shape and size of strap-clip 200 of FIGS. 2*a, b* and *c*.

Figure 3B:
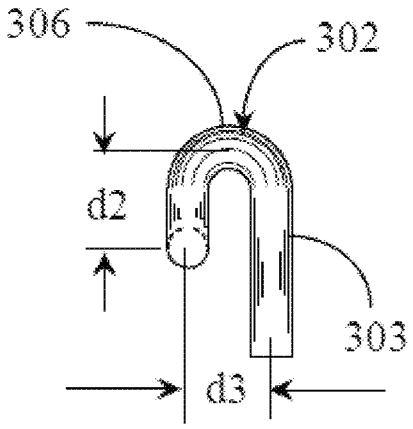
FIG. 3*b* is a side view of the strap-clip of FIG. 3*a*, in the direction of arrow Vb.
Figure 3C:
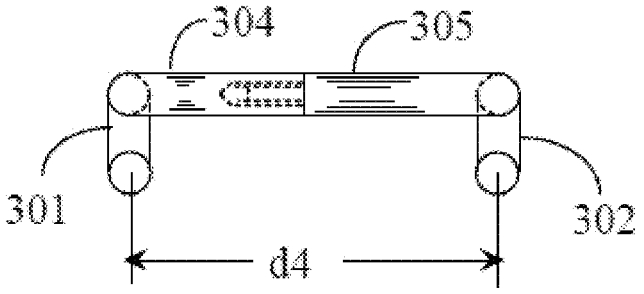
FIG. 3*c* is an end view of the strap-clip of FIG. 3*a* in the direction of arrow Vc.
Figure 3D:
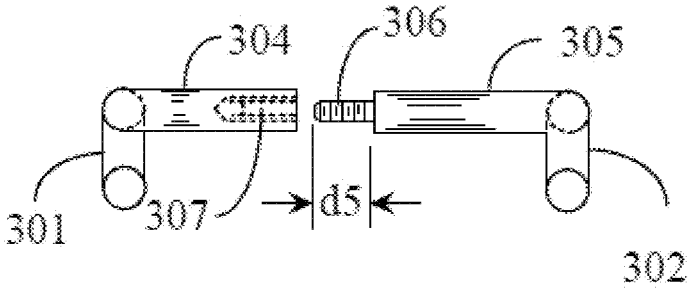
FIG. 3*d* is an end view of the strap-clip of FIG. 3*a* with two parts shown separated.

FIG. 3*b* is a side view of the strap-clip of FIG. 3*a*, in the direction of arrow Vb, FIG. 3*c* is an end view of the strap-clip of FIG. 3*a* in the direction of arrow Vc, and FIG. 3*d* is an end view of the strap-clip of FIG. 3*a* with parts 301 and 302 shown separated by disengagement of the threaded elements.

An important purpose of the threaded design is that the strap-clip 300 may be adjusted for the center-to-center distance between extensions 301 and 302, which allows adjustment for the center-to-center distance between eyelets for laces in a shoe. In this particular embodiment dimension d4 may be extended by up to not quite d5, as a small portion of threaded extension 306 must remain in female thread 307 for the strap-clip to be useful for a shoe.

Figure 4:
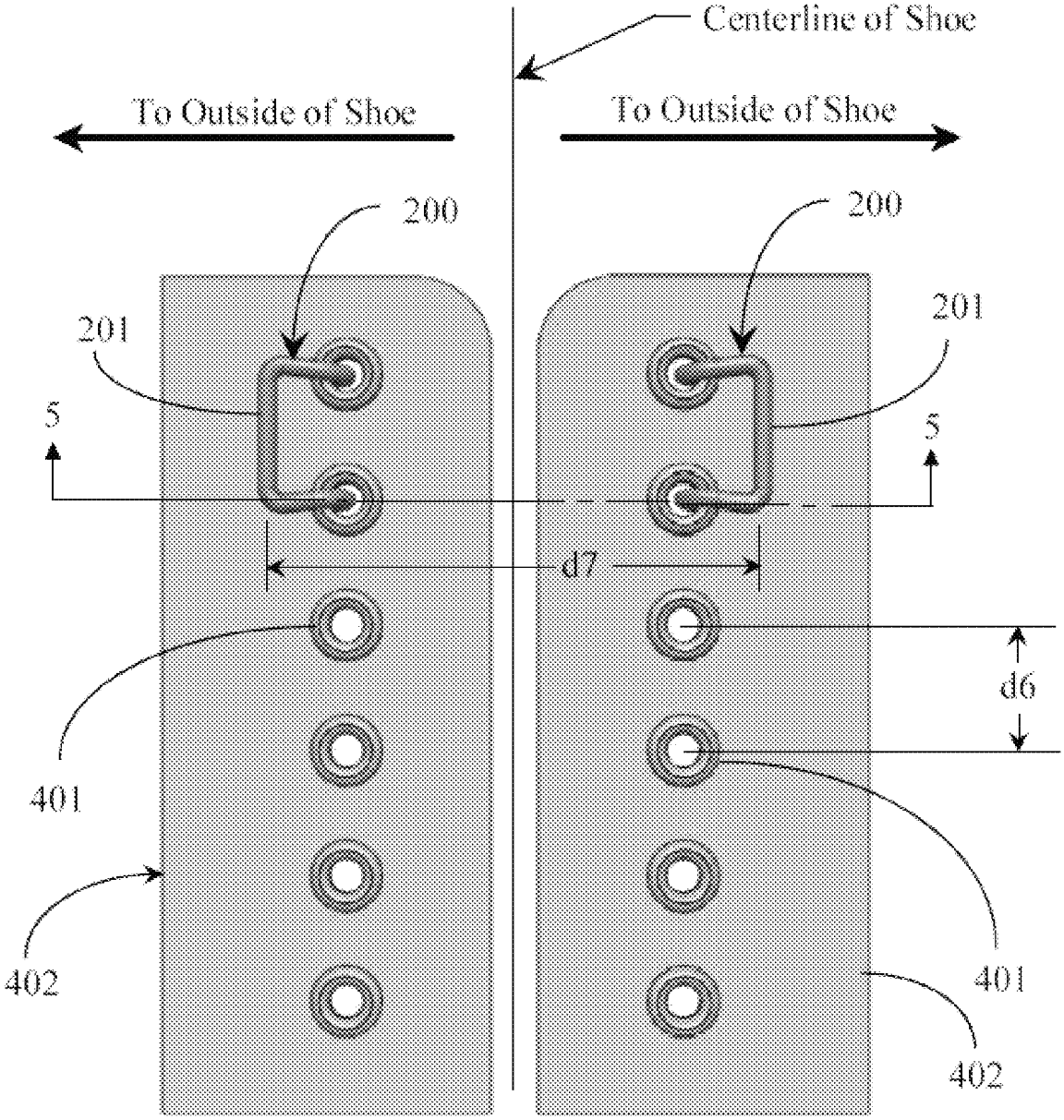
FIG. 4 is a top-down view of the two sides of a lacing region of a shoe showing strap-clips engaged in lacing eyelets of a shoe.

FIG. 4 is a top-down view of the two sides of a lacing region of a shoe showing strap-clips 200 engaged in lacing eyelets 401 formed in shoe fabric 402 of a shoe. There are six eyelets 401 on each side of a centerline of the shoe (only two are numbered), for a total of twelve eyelets, with a center-to-center spacing of d6. It is important that strap-clips 200 be engaged in eyelets 401 such that bars 201 are positioned to the outside of the shoe on each side, rather than to the inside. The importance is to establish a separation d7 such that strap-closures 105 (see FIGS. 1*a* and 1*b*) have sufficient working area to operate properly for the closures. If the strap-clips were reversed from the positions shown bars 201 would be very close, and the strap-closures wouldn't work properly.

It may be seen in FIG. 4 that the geometry of strap-clips 200 is somewhat altered from the geometry of the clips shown in FIGS. 2*a, b* and *c*. In FIGS. 2*a, b* and *c* bar 201 is seen to bend ninety degrees at each end, and then to bend through 180 degrees to the extensions 202. In alternative embodiments, as shown, for example, in FIG. 4, the initial bend is more than ninety degrees, such that the width of the strap-clip decreases somewhat from the bar toward the 180 degree bend. This variation in different embodiments may be as much as fifteen degrees. Further, the bends shown as 180 degrees as regions 203 may be in some embodiments a bit more or less than 180 degrees.

Figure 5:
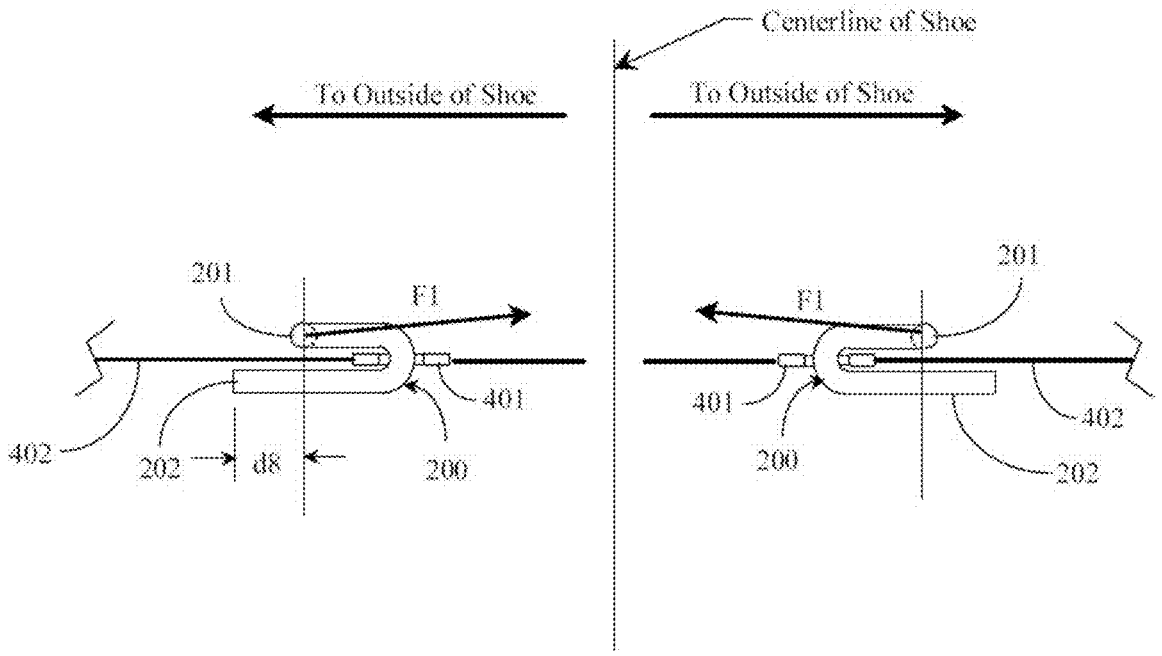
FIG. 5 is a side elevation section view of strap-clips engaged in eyelets to illustrate the positioning and leverage of different portions of a strap-clip with the eyelets and the cloth material in which the eyelets are situated.

FIG. 5 is a side elevation section view of strap-clips 200 engaged in eyelets 401 to illustrate the positioning and leverage of different portions of a strap-clips engaged in eyelets with the eyelets and the cloth material 402 in which the eyelets are situated. In this view only the cloth and the eyelets are sectioned, not the strap-clips. An important feature is that as engaged in the eyelets the extension 202 extends toward the outside of the shoe on each side substantially further than does bar region 201, to which a strap-closure is connected on one side and wrapped around the bar on the opposite side (not shown in FIG. 5). In use a strap-closure 105 when pulled and closed exerts force F1 on bar portions 201 of each strap-clip 200. This force tends to rotate strap-clips 202 about a fulcrum at one side of the engaged eyelet.

Figure 6:
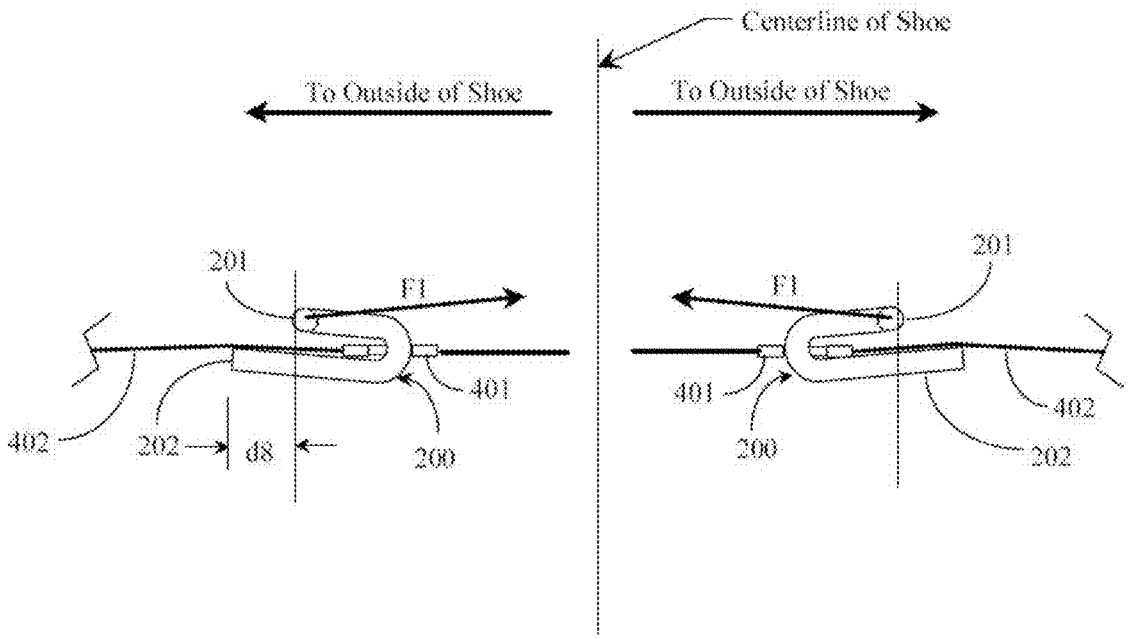
FIG. 6 is a side view of one strap-clip and eyelet of FIG. 5 to illustrate engagement of the strap-clip with the eyelet and cloth.

FIG. 6 illustrates rotation of strap-clips 200 about a fulcrum at the engaged eyelet 401, with a resulting rotation of extension 202 to bear against the underside of shoe cloth 402. It is seen that the extensions 202 rotate around the eyelet to engage the underside of shoe cloth 402, which constrains further rotation. The substantial extension of portions 202 beyond the position of bars 201 limit the rotation of the strap-clips and provide for secure engagement of the strap-clips in the eyelets of the shoe when the strap-closures are tensed and closed.

Figure 7A:
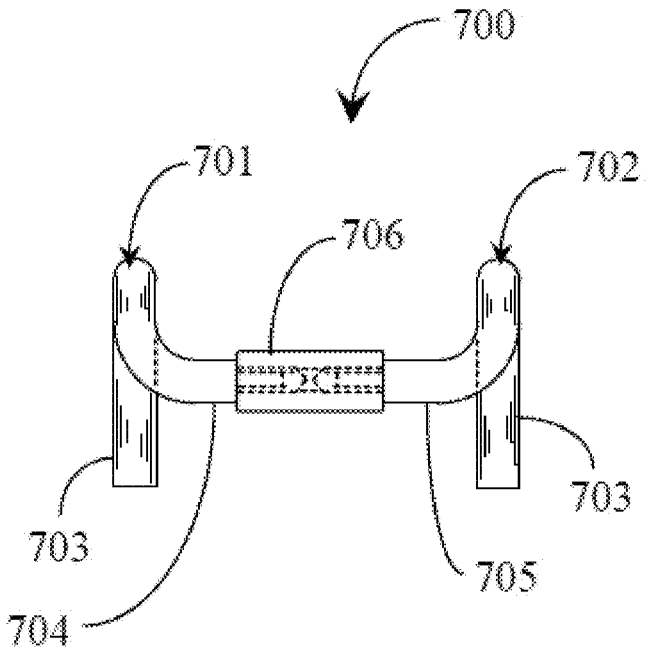
FIG. 7*a* illustrates a strap-clip in another embodiment of the invention, wherein the center-to-center spacing of extensions may be adjusted with the strap-clip engaged in adjacent eyelets.
Figure 7B:
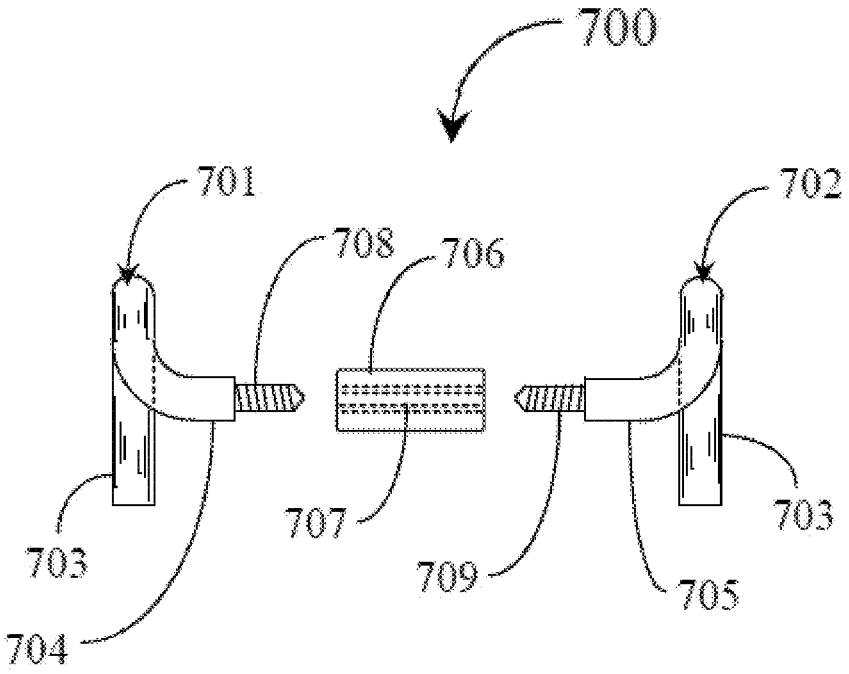
FIG. 7*b* illustrates the strap-clip of FIG. 7*a*, with the various elements disengaged.

FIG. 7*a* illustrates a strap-clip in another embodiment of the invention, wherein the center-to-center spacing of extensions 703 may be adjusted with the strap-clip engaged in adjacent eyelets. FIG. 7*b* illustrates the strap-clip of FIG. 7*a*, with the various elements disengaged. Portion 701 has the general shape of other strap-clips, with an extension 703. Bar portion 704 ends in a left-hand male thread 708. Portion 702 is a mirror image of portion 701, with an extension 703 and a bar portion 705 ending in a right-hand male thread 709. Engagement portion 706 has a left-hand female thread 707 on one end and a right-hand female thread on the other end, so the male threaded portions may be engaged in portion 706 simply by turning portion 706, without rotating portions 701 and 702. This arrangement allows strap-clip 700 to be adjusted for width after it is engaged in adjacent eyelets in a shoe.

Figure 7C:
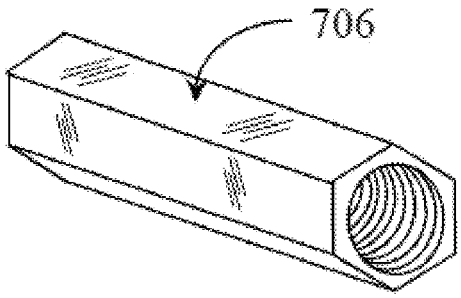
FIG. 7*c* is a perspective view of the engagement portion of FIGS. 7*a* and 7*b* in an alternative embodiment of the invention.

FIG. 7*c* is a perspective view of engagement portion 706 in one embodiment of the invention, being fabricated from hex stock providing six flat surfaces around the circumference of the element, which provide a gripping advantage for a user when adjusting the width of a strap-clip.

Figure 7D:
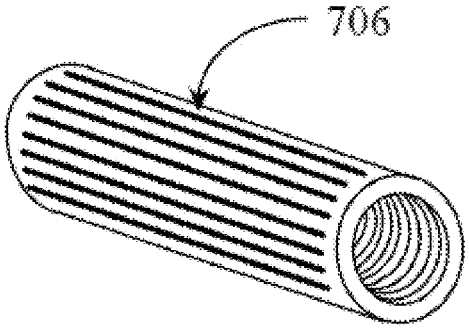
FIG. 7*d* is a perspective view of the engagement portion of FIGS. 7*a* and 7*b* in another alternative embodiment of the invention.

FIG. 7*d* is a perspective view of engagement portion 706 in an alternative embodiment of the invention, being fabricated from round stock. Longitudinal raised striations are provided on the outside surface around the circumference of the element, which also provide a gripping advantage for a user when adjusting the width of a strap-clip. It will be apparent to the skilled person that the outside surface of element 788 may also be embossed and provided in several other ways to present a roughened surface to aid a user's grip.

Figure 8A:
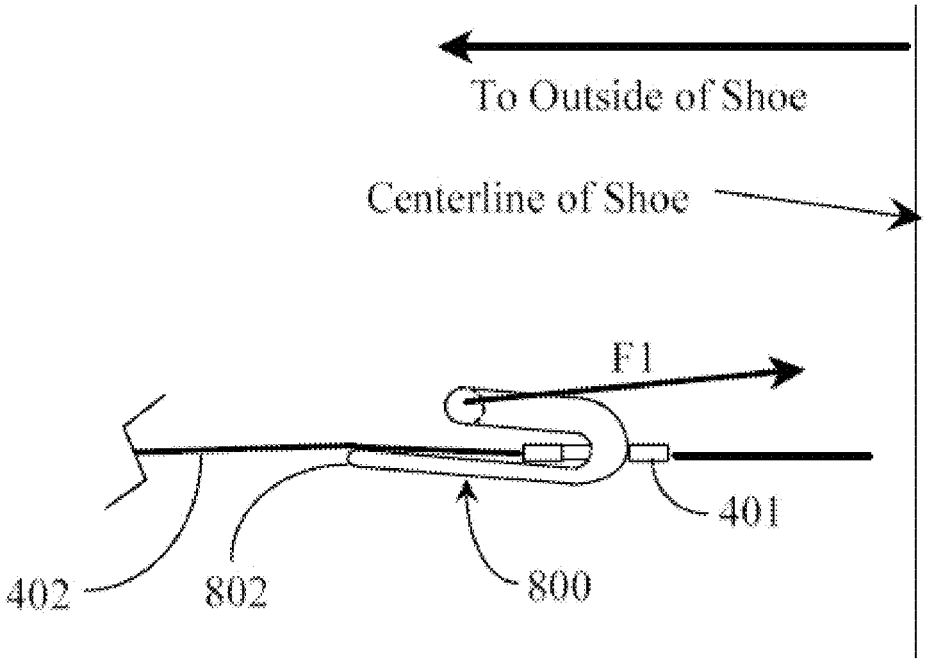
FIG. 8*a* illustrates an alternative embodiment for a strap-clip.

FIG. 8*a* illustrates an alternative embodiment of a strap-clip 800 in which the extensions engaged with eyelet 401 may reside in use below the shoe fabric 402 and pointing to the outside of the shoe, labeled here as 802, have a flattened aspect. This has an advantage of reducing interference between the shoe-clip and the tongue of the shoe and the user's upper foot.

Figure 8B:
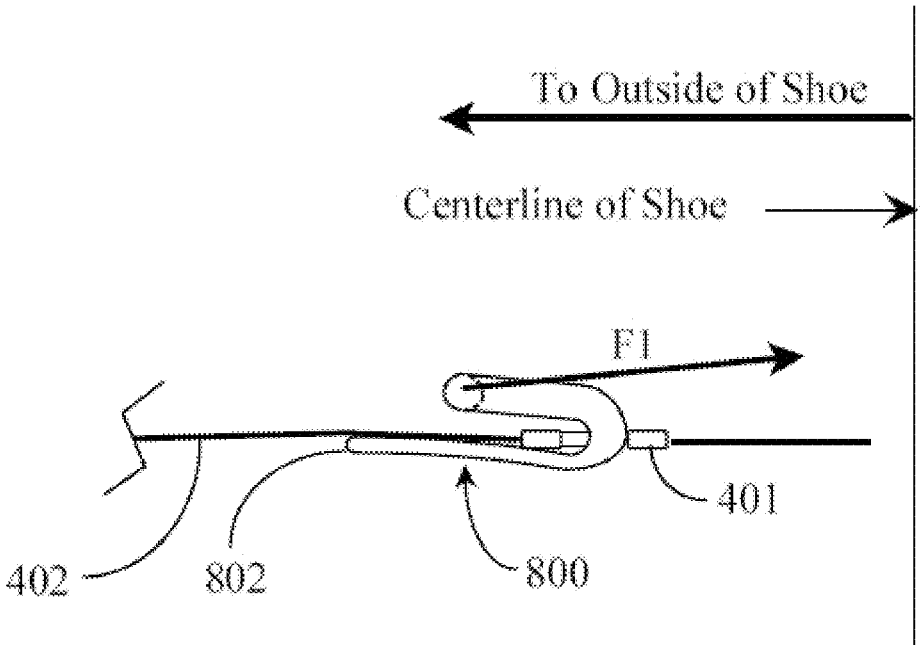
FIG. 8*b* illustrates another alternative embodiment for a strap-clip.

FIG. 8*b* illustrates an alternative embodiment of a strap-clip 800 in which the extensions engaged with eyelet 401 may reside in use below the shoe fabric and pointing to the outside of the shoe, labeled here as 802, have a flattened aspect, and are slightly curved to more closely match the curvature of the upper portion of a user's foot. This has a further advantage of reducing interference between the shoe-clip and the tongue of the shoe and the user's upper foot, and increasing the user's comfort level.

Figure 8C:
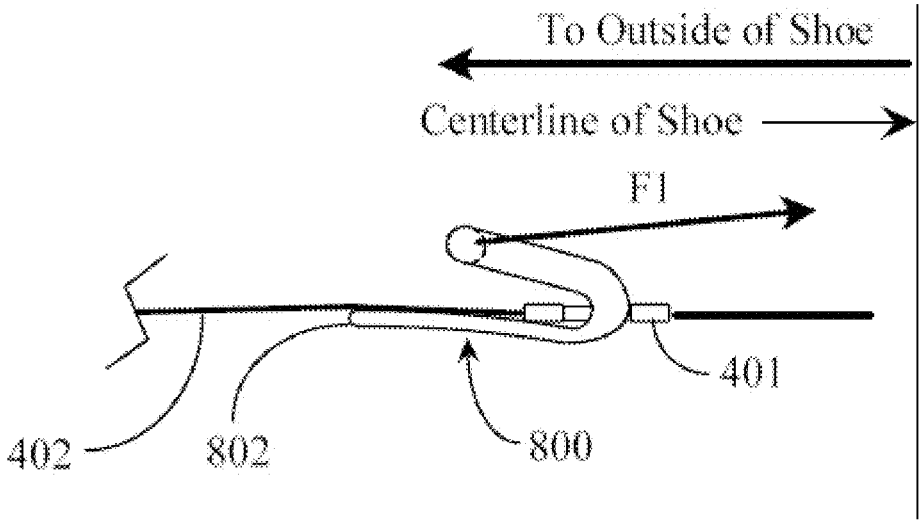
FIG. 8*c* illustrates another alternative embodiment for a strap-clip.

FIG. 8*c* illustrates an embodiment of strap clip 800, in which the extensions engaged with eyelet 401 is labeled as 802. Here, the angle through which the sides of the strap-clip turn from above the shoe fabric to below the shoe fabric 402, which is illustrated in FIGS. 2 and 3 as 180 degrees, is adjusted by 10 degrees, so the bend is 170 degrees, which allows the bar of the shoe-clip above the fabric to raise a certain amount above the fabric.

In various embodiments of the invention, as illustrated by several examples herein, the diameter of the wire or rod material used to make a strap-clip may vary, with a requirement that the rigidity be such as to reliably support the forces imposed in use with the strap-closures. It is not required in all instances that a cross-section of the wire or rod be round, and portions, such as the extensions to the outside under the show fabric, may have a flattened aspect. Further, the angle of turns of the wire or rod need not be ninety degrees exactly, or multiples of ninety degrees, but may vary somewhat as shown, for example, in FIGS. 4 and 8*c*.

Figure 9:
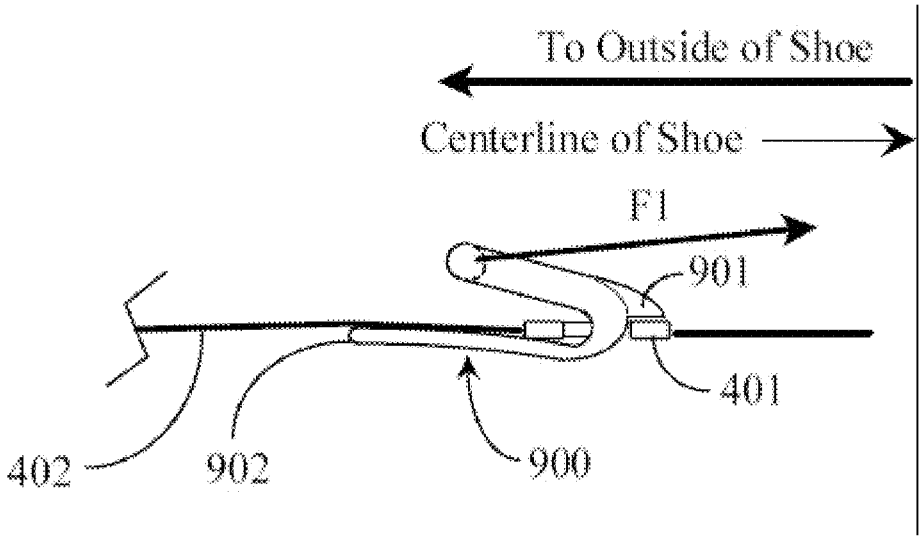
FIG. 9 illustrates an embodiment of a strap-clip in the invention having a further hook element.

FIG. 9 illustrates an embodiment of a strap-clip 900 in the invention having a further hook element 901 that serves a purpose in securing the strap-clip in an eyelet 401 of a shoe, and providing rotary constraint against the pull force of straps in use. It may be seen in FIG. 9 that force F1 will tend to cause strap-clip 900 to rotate clockwise in eyelet 401, but the degree of rotation will be constrained both by extension 902 against the underside of the shoe fabric 402, and by hook 901 against the upper surface of eyelet 401. In various embodiments hook elements 901 may be added to strap-clips by such as welding or brazing, or may be originally formed or machined into the strap-clip. There are numerous possibilities. It will be apparent as well that a hook 901 will be provided on both sides of a strap-clip, although only one is seen in FIG. 9.

Figure 10A:
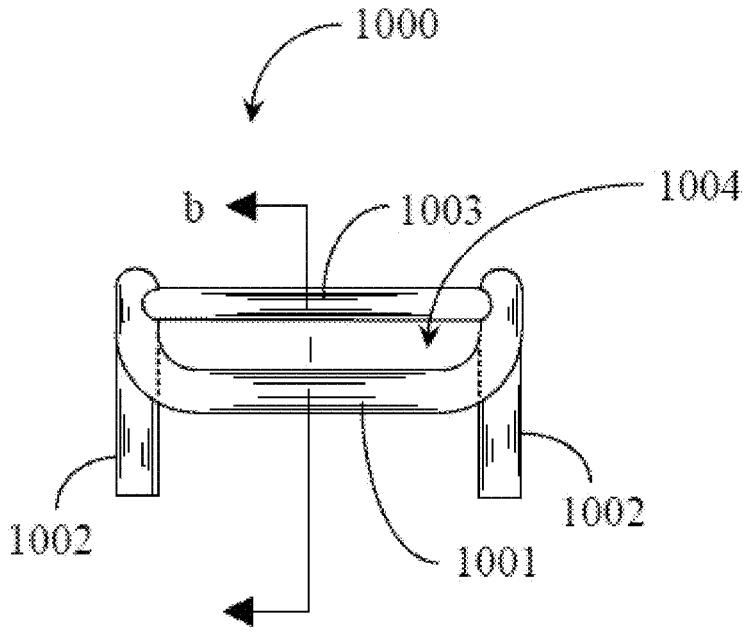
FIG. 10*a* illustrates a strap-clip in another alternative embodiment of the invention.

FIG. 10*a* illustrates a strap-clip 1000 may include parallel regions 1002 in another alternative embodiment of the invention. Strap-clip 1000 is in every respect but one the same as strap-clip 200 of FIG. 2*a*. The definitive difference being that strap-clip 1000 has a second bar element 1003 provided from side to side parallel to bar element 1001, with a space 1004 between the two bar elements.

Figure 10B:
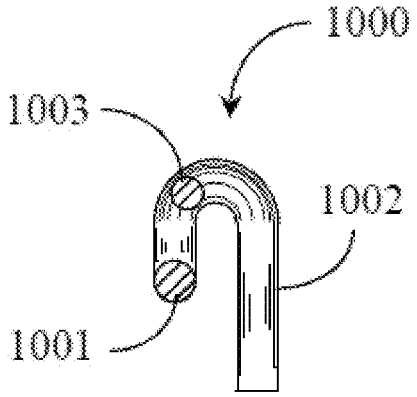
FIG. 10*b* is a side section view of the strap-clip of FIG. 10*a*.

FIG. 10*b* is a side section view of the strap-clip of FIG. 10*a*, taken along section line b-b in FIG. 10*a*, illustrating the parallel region 1002, positioning of the bar elements, providing a space 1004 between the bar elements.

Figure 10C:
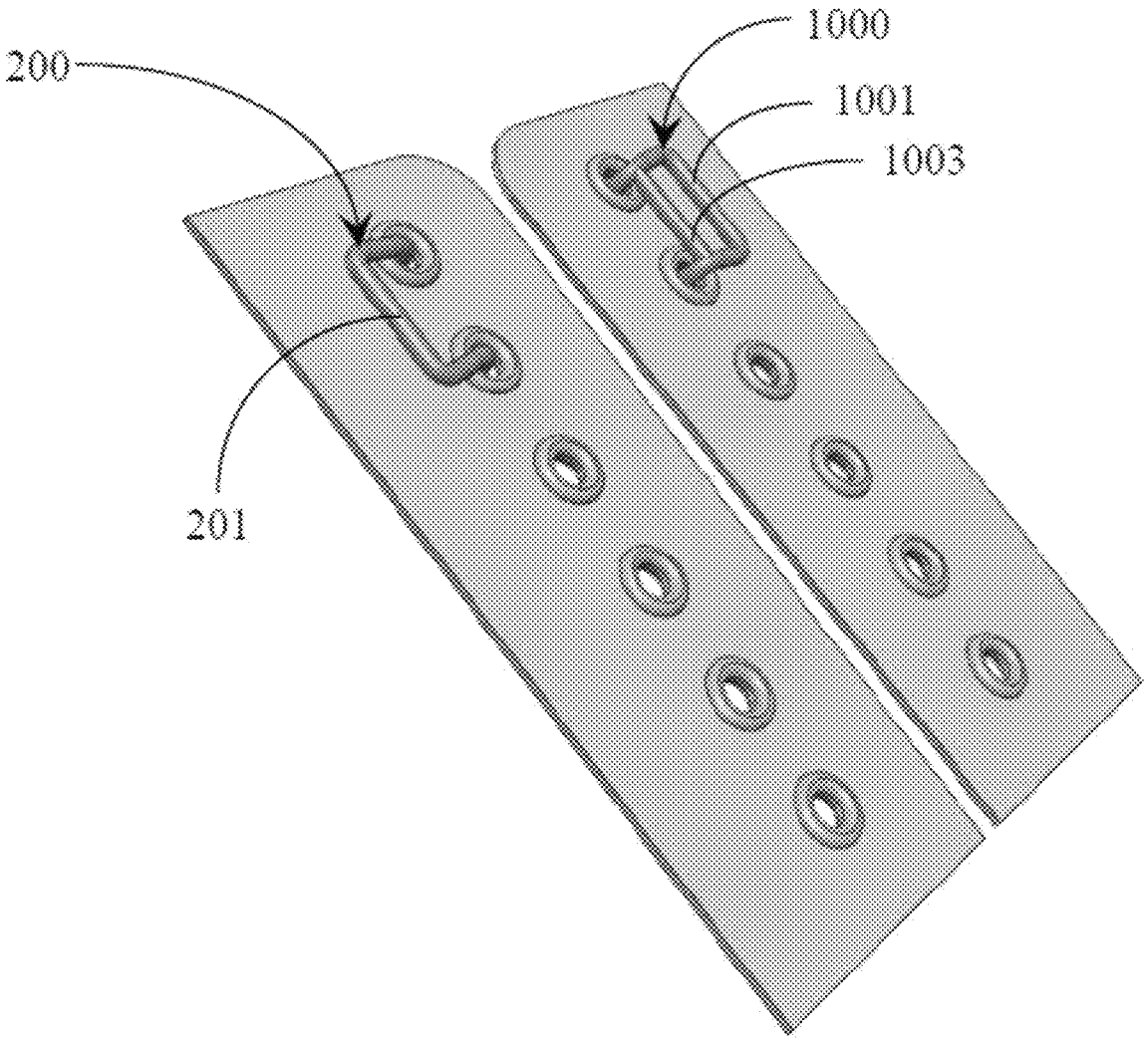
FIG. 10*c* is a perspective view of side-by-side eyelets with strap-clips in an embodiment of the invention.

FIG. 10*c* is a perspective view of side-by-side eyelets groupings with strap-clips engaged in an embodiment of the invention. In this embodiment a strap-clip 200 with a bar element 201 is engaged in two adjacent eyelets on one side of the shoe, and a strap-clip 1000 with parallel bar elements 1001 and 1003 is engaged on the opposite side to two matching eyelets. The purpose of this arrangement is described below with reference to FIG. 11. In various embodiments, the strap-clip 200 and the strap-clip 1000 may be different. For example, one strip clip may be for anchoring and the other may be for adjusting. As illustrated in FIG. 10C, the strap-clip 200 may be for anchoring while the strap-clip 1000 may be for adjusting.

Figure 10D:
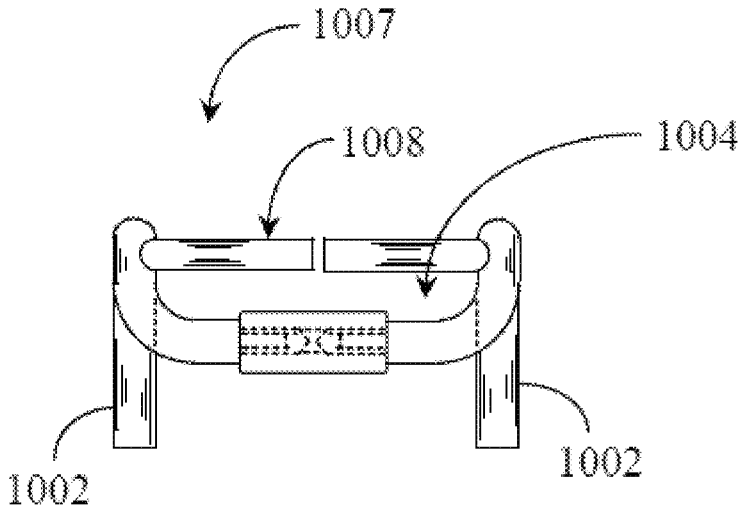
FIG. 10*d* illustrates a strap-clip in yet another embodiment of the invention.

FIG. 10*d* illustrates a strap-clip 1007 in yet another embodiment of the invention. In this embodiment strap-clip 1007 is adjustable in width by the mechanisms shown and described with reference to FIG. 7. Further, the auxiliary bar 1008, analogous to bar 1003 of FIG. 10*a*, is separated at the center so the width adjustment mechanism may function. The strap-clip 1007 may include parallel regions 1002 and bar elements creating a space 1004.

Figure 10E:
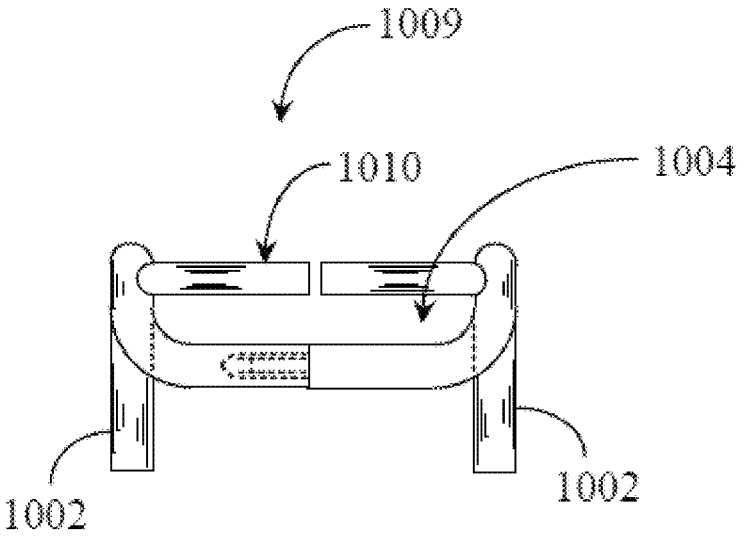
FIG. 10*e* illustrates a strap-clip in yet another embodiment of the invention.

FIG. 10*e* illustrates a strap-clip 1009 that is adjustable by the mechanisms shown and described with reference to FIGS. 3*a*-3*d*. Auxiliary bar 1010 is separated just as is bar 1008 in FIG. 10*d*, for the same purpose. The strap-clip 1007 may include parallel regions 1002 and bar elements creating a space 1004.

Figure 11:
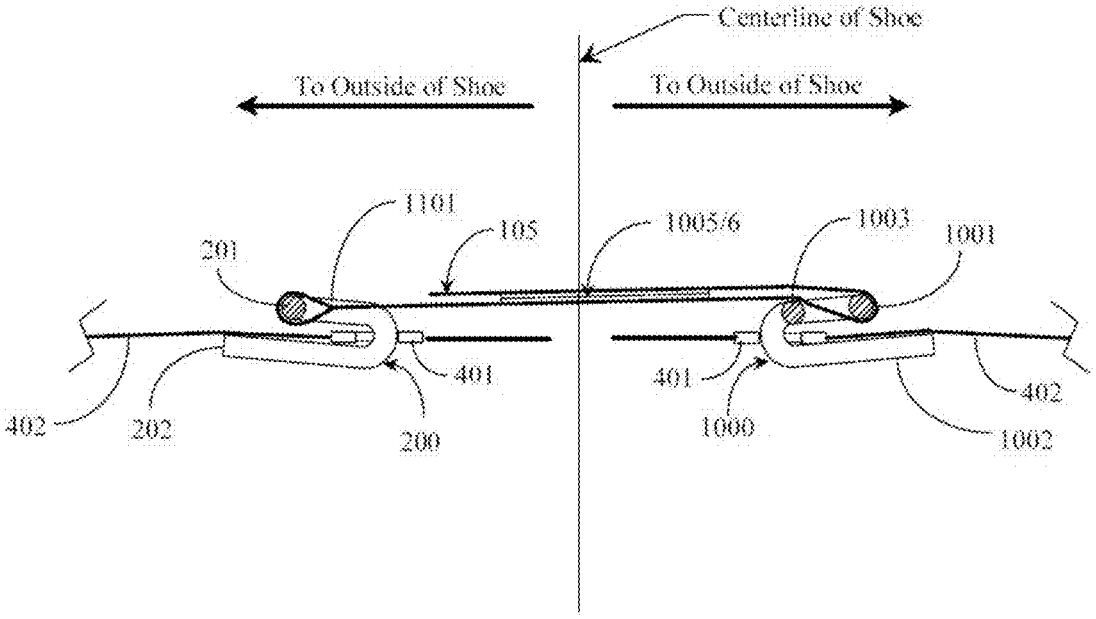
FIG. 11 is a side, partially sectioned view of a closure arrangement in an embodiment of the invention.

FIG. 11 is a side, partially sectioned view of a closure arrangement in an embodiment of the invention. In this arrangement a strap-clip 200 is engaged in two adjacent eyelets 401 on one side, and a strap-clip 1000 with an extra bar element 1003 is engaged in the matching eyelets on the opposite side. A strap-closure 105 having a parallel region 1002, as seen in FIGS. 2*a* and 2*b*, is fastened to strap-clip 200 around bar element 201, in this implementation by sewing at point 1101. Strap-closure 105 proceeds to strap-clip 1000 on the opposite side of the show, passes over bar element 1003, under bar element 1001, and doubles back over itself toward the first side. To complete, the closure hook-and-loop elements 1005 and 1006 mate to secure the strap element to itself.

The point of the extra bar element 1003 is that now, with the strap-closure open, both strap-clips 200 and 1000 may be disengaged from the eyelets, and the unit of the two strap-clips and the strap-closure may be moved to temporary storage, or may be engaged as a unit in different eyelet pairs of the same or a different shoe. Strap-clip 200 is captured by the fact of being sewn to the strap-closure, and strap-clip 1000 is captured on the strap-closure by the fact of the strap passing through the space between bar element 1001 and 1003.

Figure 12A:
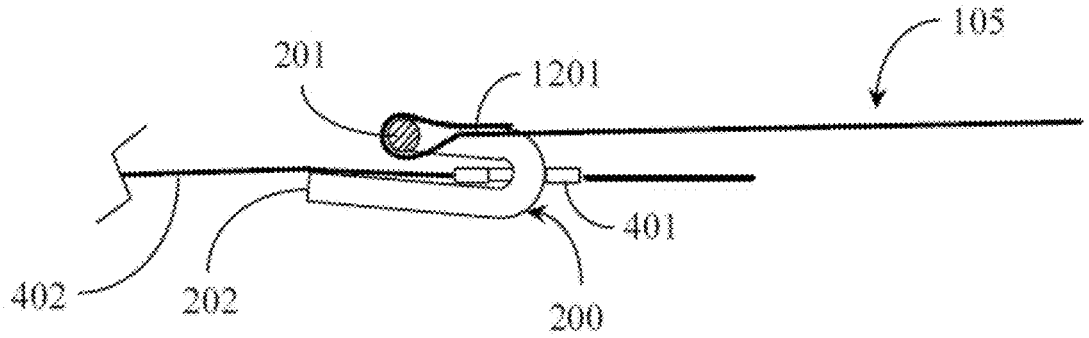
FIG. 12*a* is a side view illustrating an alternate way to fasten a strap-closure to a strap-clip.

FIG. 12*a* illustrates an alternative way to fasten a strap-closure to a strap-clip about the shoe fabric 402 and eyelet 401. In this embodiment strap-closure 105 is fastened to strap-clip 200 by wrapping one end around the bar 201 and closing with hook-and-loop fasteners 1201 in the same way that the strap-closure joins to itself to finish the closure. This joining may be opened, so a strap-closure may be removed from any strap-clip and joined to another.

Figure 12B:
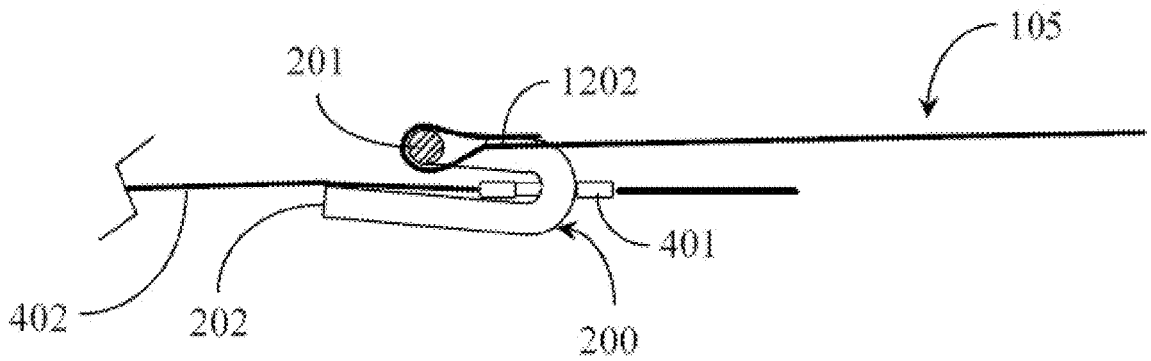
FIG. 12*b* is a side view illustrating another alternate way to fasten a strap-closure to a strap-clip.

FIG. 12*b* illustrates another alternative way to fasten a strap-closure to a strap-clip about the shoe fabric 402 and eyelet 401. In this embodiment strap-closure 105 is fastened to strap-clip 200 having a parallel region 202 by wrapping one end around the bar 201 and closing with small matching snap elements 1202. This also makes a strap-clip portable and changeable.

Figure 12C:
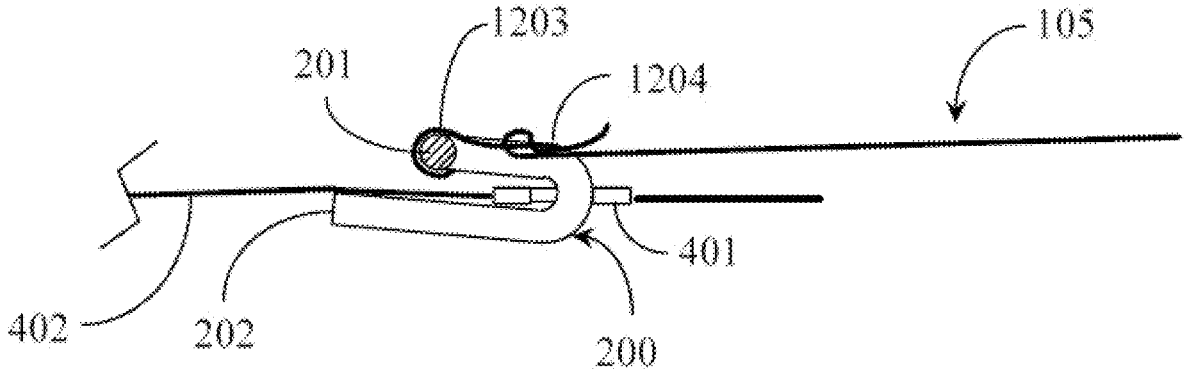
FIG. 12*c* is a side view illustrating yet another alternate way to fasten a strap-closure to a strap-clip.

FIG. 12*c* illustrates another alternative way to fasten a strap-closure to a strap-clip. In this embodiment strap-closure 105 is fastened to strap-clip 200 having a parallel region 202 by a spring-metal element 1203 that curves around bar element 201 by somewhat more than 270 degrees, and the spring-metal element has a buckle end 1204 for engaging the strap element. The spring-metal element can be placed against bar element 201, and spread to engage by pushing inward. It may be similarly disengaged.

Figure 13A:
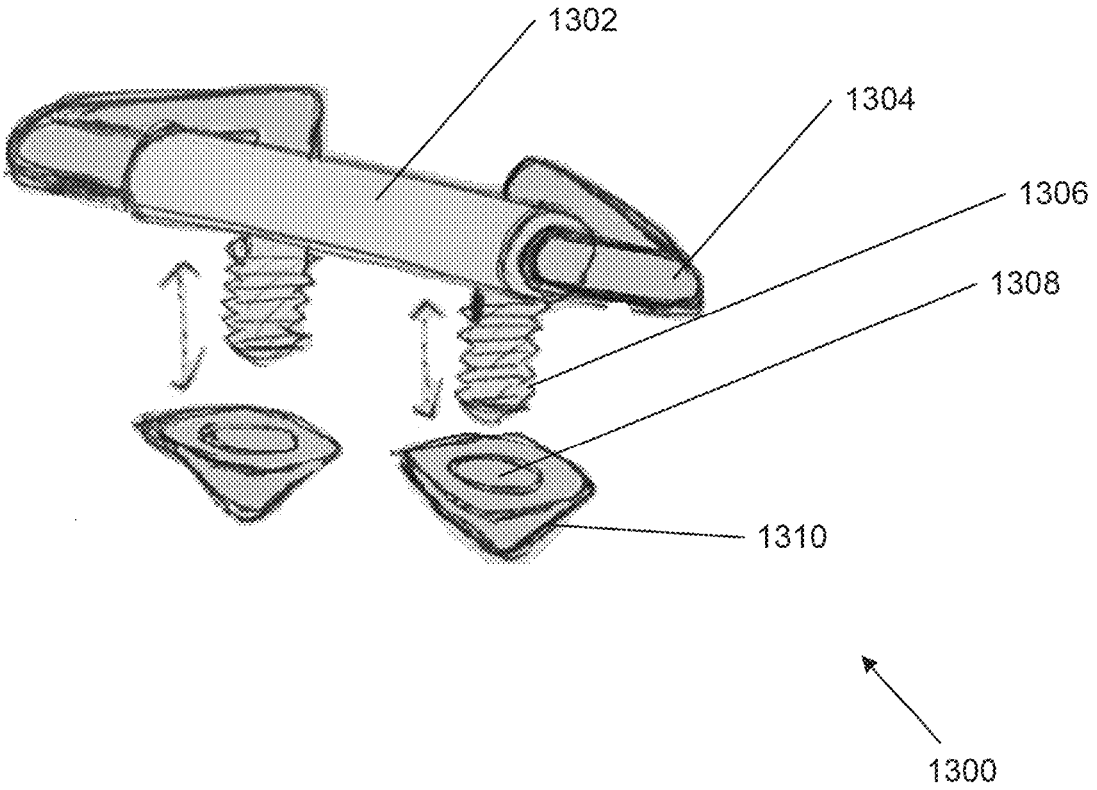
FIG. 13*a* illustrates a strap-clip in yet another embodiment of the invention.

FIG. 13*a* illustrates a strap-clip 1300 in another alternative embodiment of the invention. The diagram 1300 shows a bar region 1302 that may be formed of a round rod material, which may be metal or polymer in different embodiments. At each end of the bar region 1302, the rod may be shaped as a bent region 1304. The bent region 1304 may extend downwards on each side to a threaded region 1306. The threaded region 1306 may be inserted into a threaded bore 1308 of a cap 1310 such as (but not limited to) a nut cap. In various embodiments, such strap-clip structures may enable easy access to shoe eyelets. For example, the threaded regions 1306 may slide through a pair of eyelets of a shoe, and then be fastened to the shoe with the cap 1310. The bar region 1302, may rest above the eyelets on the top surface of the shoe. In some embodiments, the bar region 1302 may be similar and/or identical in appearance and function as the bar regions described above with respect to FIG. 3 and FIG. 7.

Figure 13B:
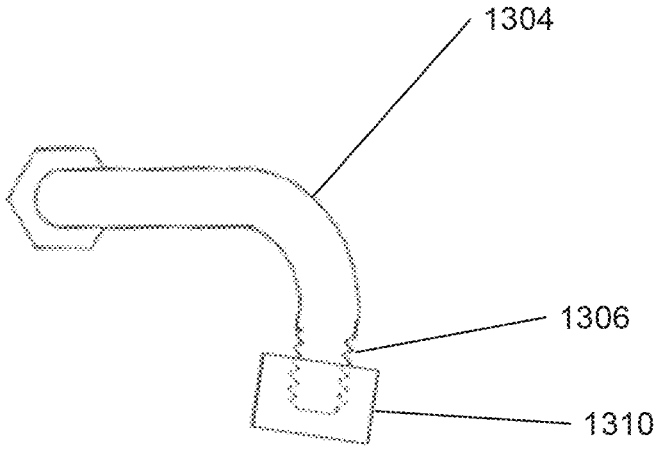
FIG. 13*b* is a side section view of the strap-clip in FIG. 13*a*.

FIG. 13*b* illustrates a side section view of the strap-clip in FIG. 13*a*. The side section view shows the bent region 1304 and the threaded region 1306. As illustrated, the cap 1310 may be mated with the threaded region 1306 to fasten the strap-clip to the eyelets of the shoe.

In different embodiments of the invention strap-closures 105 may be made of cloth, canvas, fabric and other materials, and may be provided in a wide range of colors and designs including indicia of various sorts.

A person of ordinary skill will recognize that the implementations and examples shown and described in this specification with reference to the various figures, are all exemplary only, and not limiting, as there are alternative ways of accomplishing many of the elements and functions that all fall within the spirit and scope of the invention.

I claim:

1. A shoe fastening system for a shoe comprising: an anchoring strap-clip configured to attach to a first pair of eyelets of the shoe comprising:

two parallel regions configured to be positioned inside the shoe under the first pair of eyelets;

a bar region of the anchoring strap-clip, configured to traverse the first pair of eyelets on the outside of the shoe, wherein the bar region of the anchoring strap-clip is threadably separable into a first split bar region and a second split bar region; and two curved regions connecting the parallel regions to the bar region, wherein the two curved regions traverse through the first pair of eyelets;

an adjustment strap-clip configured to attach to a second pair of eyelets of the shoe comprising:

two parallel regions configured to be positioned inside the shoe under the second pair of eyelets;

a bar region of the adjustment strap-clip, configured to traverse the second pair of eyelets on the outside of the shoe; and two curved regions connecting the parallel regions to the bar region, wherein the two curved regions traverse through the second pair of eyelets: and a strap closure comprising:

an anchoring end portion configured to attach to the bar region of the anchoring strap-dip;

an adjustable end portion configured to traverse under the bar region of the adjustrnent strap-dip that allows for the shoe to be fasten; and a fastening portion configured to connect the anchoring end portion with the adjustable end portion.

2. The shoe fastening system of claim 1, wherein the first split bar region of the anchoring strap-clip comprises a female threaded end and the second split bar region of the anchoring strap-clip comprises an extended male thread that engages the female threaded end.

3. The shoe fastening system of claim 1, wherein the bar region of the anchoring strap-clip further comprises an engagement portion comprising a left-hand female thread on one end and a right-hand female thread on the other end.

4. The shoe fastening system of claim 3, wherein the engagement portion has a circular profile and longitudinal raised striations on the outside surface around the circumference of the engagement portion.

5. The shoe fastening system of claim 3, wherein the engagement portion has a hexagonal profile having six flat surfaces around the circumference of the engagement portion.

6. The shoe fastening system of claim 3, wherein: the first split bar region of the anchoring strap-clip includes a right-hand male thread that mates with the engagement portion's right-hand female thread; and the second split bar region of the anchoring strap-clip includes a left-hand male thread that mates with the engagement portion's left-hand female thread.

7. The shoe fastening system of claim 1, wherein the anchoring strap-clip further comprises a hook element for securing the anchoring strap-clip in the first pair of eyelets.

8. The shoe fastening system of claim 1, wherein the anchoring strap-clip rotates about a fulcrum due to a force on the bar region of the anchoring strap-clip, such that the rotation of the two parallel regions of the anchoring strap-clip is constrained by the underside of the shoe.

9. The shoe fastening system of claim 8, wherein the two parallel regions of the anchoring strap-clip extend further to an outside of the shoe than the bar region of the anchoring strap-clip such that the rotation of the adjustment strap-clip provides a secure engagement when the fastening portion connects the anchoring end portion with the adjustable end portion of the strap closure in fastening the shoe.

10. The shoe fastening system of claim 1, wherein the bar region of the adjustment strap-clip is separable into a first split bar region and a second split bar region.

11. The shoe fastening system of claim 10, wherein the first split bar region of the adjustment strap-clip comprises a female threaded end and the second split bar region of the adjustment strap-clip comprises an extended male thread that engages the female threaded end.

12. The shoe fastening system of claim 10, wherein the bar region of the adjustment strap-clip further comprises an engagement portion comprising a left-hand female thread on one end and a right-hand female thread on the other end.

13. The shoe fastening system of claim 12, wherein the engagement portion has a circular profile and longitudinal raised striations on the outside surface around the circumference of the engagement portion.

14. The shoe fastening system of claim 12, wherein the engagement portion has a hexagonal profile having six flat surfaces around the circumference of the engagement portion.

15. The shoe fastening system of claim 12, wherein: the first split bar region of the adjustment strap-clip includes a right-hand male thread that mates with the engagement portion's right-hand female thread; and the second split bar region of the adjustment strap-clip includes a left-hand male thread that mates with the engagement portion's left-hand female thread.

16. The shoe fastening system of claim 10, wherein the adjustment strap-clip further comprises a hook element for securing the adjustment strap-clip in the first pair of eyelets.

17. The shoe fastening system of claim 10, wherein the adjustment strap-clip further comprises a hook element for securing the adjustment strap-clip in the second pair of eyelets.

18. The shoe fastening system of claim 1, wherein the adjustment strap-clip further comprises a hook element for securing the adjustment strap-clip in the second pair of eyelets.

19. The shoe fastening system of claim 1, wherein the adjustment strap-clip rotates about a fulcrum due to forces on the bar region of the anchoring strap-clip, such that the rotation of the two parallel regions of the anchoring strap-clip is constrained by the underside of the shoe.

20. The shoe fastening system of claim 19, wherein the two parallel regions of the adjustment strap-clip extend further to an outside of the shoe than the bar region of the adjustment strap-clip such that the rotation of the adjustment strap-clip provides a secure engagement when the fastening portion connects the anchoring end portion with the adjustable end portion of the strap closure in fastening the shoe.

* * * * *